US010352006B2

(12) United States Patent
Crocker

(10) Patent No.: US 10,352,006 B2
(45) Date of Patent: Jul. 16, 2019

(54) RUMBLE STRIP FORMING APPARATUS AND METHOD

(71) Applicant: Waterblasting, LLC, Stuart, FL (US)

(72) Inventor: James P. Crocker, Stuart, FL (US)

(73) Assignee: Waterblasting, LLC, Stuart, FL (US)

( * ) Notice: Subject to any disclaimer, the term of this patent is extended or adjusted under 35 U.S.C. 154(b) by 0 days.

(21) Appl. No.: 15/928,166

(22) Filed: Mar. 22, 2018

(65) Prior Publication Data

US 2018/0371711 A1 Dec. 27, 2018

Related U.S. Application Data

(60) Provisional application No. 62/475,269, filed on Mar. 23, 2017.

(51) Int. Cl.

| | |
|---|---|
| ***E01C 23/00*** | (2006.01) |
| ***E01C 23/09*** | (2006.01) |
| ***E01F 9/529*** | (2016.01) |
| ***E01C 23/088*** | (2006.01) |

(52) U.S. Cl.

CPC ..... *E01C 23/0993* (2013.01); *E01C 23/088* (2013.01); *E01C 23/0946* (2013.01); *E01F 9/529* (2016.02)

(58) Field of Classification Search

CPC ..... E01C 23/088; E01C 23/0993; E01F 9/529
USPC ..... 404/75, 90, 94
See application file for complete search history.

(56) References Cited

U.S. PATENT DOCUMENTS

| | | | |
|---|---|---|---|
| 4,701,069 | A | 10/1987 | Whitney |
| 4,764,051 | A | 8/1988 | Whitney |
| 5,415,495 | A | 5/1995 | Johnson |
| 5,582,490 | A | 12/1996 | Murray |
| 5,676,490 | A | 10/1997 | Nelson |
| 5,860,764 | A | 1/1999 | Roberts |
| 6,210,071 | B1 | 4/2001 | McSharry |
| 6,220,783 | B1 | 4/2001 | Maxwell |
| 6,364,419 | B1 | 4/2002 | Cannizzo et al. |
| 6,454,490 | B1 | 9/2002 | Murphy |
| 6,505,995 | B2 | 1/2003 | Sanfilippo et al. |
| 6,547,484 | B2 | 4/2003 | Murphy |
| 6,612,773 | B2 | 9/2003 | Gray |
| 6,755,482 | B2 | 6/2004 | Johnson |
| 7,029,072 | B1 | 4/2006 | Murray et al. |
| 7,029,370 | B2 | 4/2006 | Cochran et al. |
| 7,168,886 | B2 | 1/2007 | Loader |
| 7,325,881 | B2 | 2/2008 | Cochran et al. |
| 7,625,152 | B2 | 12/2009 | Swamidass |

(Continued)

FOREIGN PATENT DOCUMENTS

| | | |
|---|---|---|
| EP | 0298682 | 1/1989 |

*Primary Examiner* — Raymond W Addie
(74) *Attorney, Agent, or Firm* — McHale & Slavin, P.A.

(57) ABSTRACT

The present device is a rumble strip forming apparatus for reducing the amount of reactive force transferred to the transporter. The rumble strip forming apparatus includes a transport, a lift device, a grinder, and a drive means that connect drive portions of the transport to the grinder to synchronize engagement of a cutting device with the pavement with forward movement of the transport while providing rearward movement of the grinder drum during cutting. The grinder is configured to provide both rotation of a pavement cutter and up and down movement of the pavement cutter while portions of the grinder remain in contact with the pavement.

20 Claims, 13 Drawing Sheets

(56) References Cited

U.S. PATENT DOCUMENTS

| | | | | |
|---|---|---|---|---|
| 7,731,448 | B2 | 6/2010 | Fillie | |
| 7,798,158 | B2 | 9/2010 | Crocker | |
| 8,491,219 | B2 | 7/2013 | Abresch et al. | |
| 8,821,063 | B2 | 9/2014 | Johnson et al. | |
| 9,574,310 | B2 | 2/2017 | Johnson et al. | |
| 2002/0176746 | A1* | 11/2002 | Murphy | E01C 23/0993 404/75 |
| 2004/0005190 | A1* | 1/2004 | Jakits | E01C 23/0993 404/75 |
| 2015/0086268 | A1 | 3/2015 | Johnson et al. | |
| 2016/0053446 | A1* | 2/2016 | Killion | E01C 23/088 299/1.5 |

* cited by examiner

RUMBLE STRIP FORMING APPARATUS AND METHOD

PRIORITY CLAIM

In accordance with 37 C.F.R. 1.76, a claim of priority is included in an Application Data Sheet filed concurrently herewith. Accordingly, the present invention claims priority to U.S. Provisional Patent Application No. 62/475,269, entitled "Rumble Strip Forming Apparatus And Method", filed Mar. 23, 2017. The contents of the above referenced application are incorporated herein by reference in its entirety.

FIELD OF THE INVENTION

An apparatus is provided for forming rumble strips along roadways. The rumble strip apparatus is securable to a vehicle chassis to provide transportation and power to the rumble strip apparatus.

BACKGROUND OF THE INVENTION

Numerous machines and methods are available for forming so-called rumble strips along roadways. Rumble strips are provided at the margins of the driving lane so that, when encountered by the wheels of a vehicle, the vehicle is vibrated and sound is generated to inform the driver that the vehicle has wandered from the driving lane. A rumble strip can be in one of two forms. It can be a series of elongate raised ribs spaced apart along the length of the road, or a rumble strip can also be a series of elongate grooves in the roadway. A rumble strip can be formed in either the shoulder material or in the surface of the roadway itself, depending on the need. The rumble strips can be positioned adjacent to each other to provide a constant rumble, or they can include periodic spacing that provides an interrupted rumble when driven over.

In the case of the rumble strip being in the form of a series of spaced apart grooves, they are formed by a machine that cuts the grooves after the shoulder or roadway is formed. Because the cutter has to be raised and lowered to effect formation of spaced apart grooves, large generally vertical force has to be applied to both lift the cutter out of a formed groove and lower the cutter into the surface being cut. These forces cause reactive forces to the machine, often causing violent bouncing of the machine carrying the cutter head and the operator. Also, there are generally horizontal forces being applied to the cutter head because of the engagement of the cutter head with the pavement during cutting. Generally horizontal reactive forces are applied to machine.

Rumble strip forming machines are often single function dedicated machines that, when not in use, are an unnecessary expense to the owner/operator. They also tend to require a separate transport device to move them to the worksite and to unload them. Then, when the work is complete, they require loading back onto the transport device for transportation back to storage. This increases the cost of operation to the owner/operator.

There is thus a need for an improved apparatus for cutting rumble strips in pavement. There is also a need for a rumble strip forming machine that provides a smoother profile to the formed area to reduce or prevent tires from catching against the sides of the ground profile when crossed.

SUMMARY OF THE INVENTION

The present invention involves the provision of a rumble strip forming apparatus that reduces the amount of reactive force to the apparatus transporter. The rumble strip forming device is mountable on various vehicle chassis for easy transport and use of the device. The rumble strip forming device is powered by the vehicle engine through the use of hydraulics to provide smooth, powerful and reliable operation without undue weight requirements.

The present invention also involves the provision of such an apparatus that can use a transporter that is separatable from the cutting mechanism.

The present invention also involves the provision of a combined transporter and cutting mechanism that is operable to time the up-and-down cutting operation with the forward motion of the transporter.

The present invention also provides a profile to the side edges of the formed depression to smooth the transition between the upper and lower surfaces.

Other objects and advantages of this invention will become apparent from the following description taken in conjunction with any accompanying drawings wherein are set forth, by way of illustration and example, certain embodiments of this invention. Any drawings contained herein constitute a part of this specification, include exemplary embodiments of the present invention, and illustrate various objects and features thereof.

DETAILED DESCRIPTION OF THE INVENTION

Figure 1:
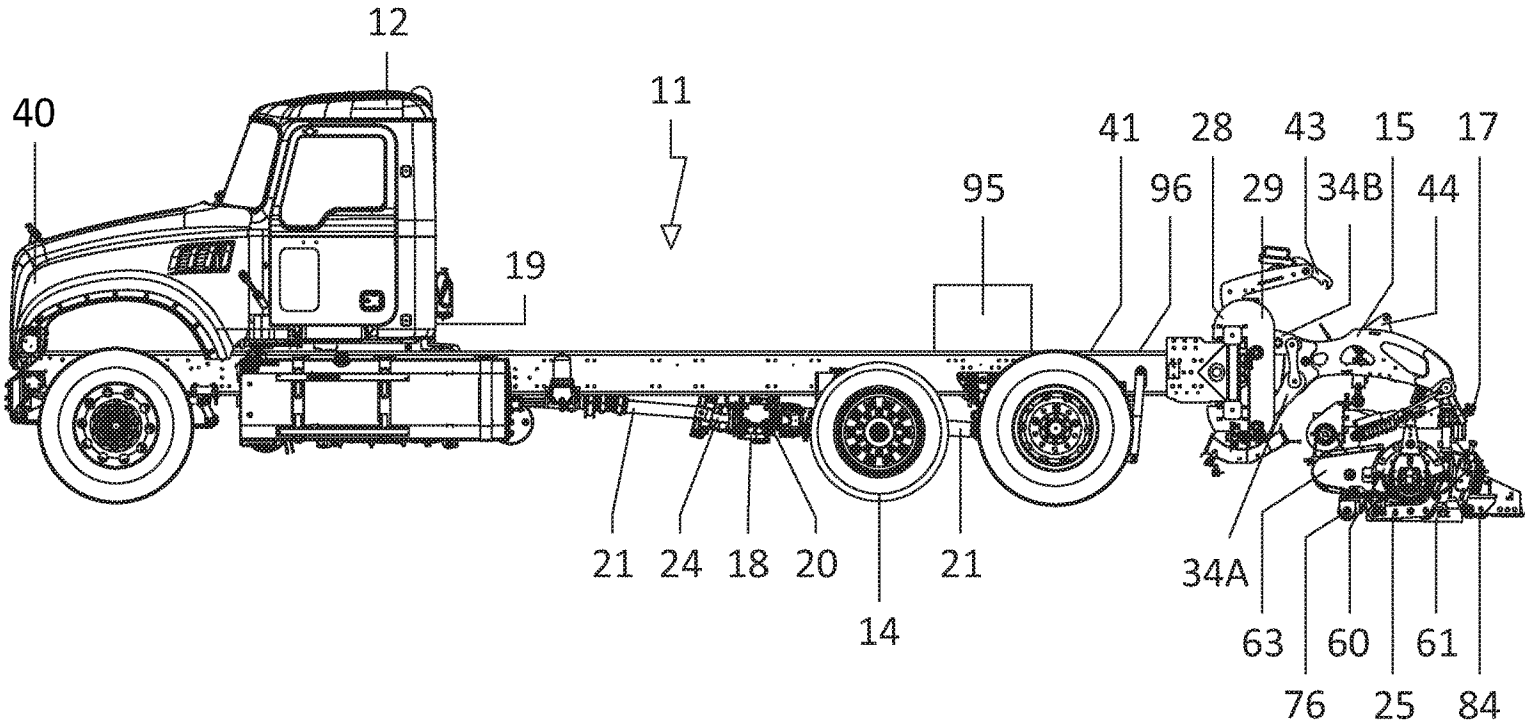
FIG. 1 is a schematic illustration of an apparatus for forming rumble strips.

Now referring to the Figures. The reference numeral 11 designates generally an apparatus for forming rumble strips in a roadway or the like. The formed rumble strip is in the form of a series of elongate grooves cut into the pavement, with the grooves being in spaced apart relationship along the length of the pavement and extending transverse to the direction of vehicle travel. Such rumble strips are well known in the art. They may be on the order of 12 to 18 inches long (transverse to vehicle travel), and 4 to 8 inches wide with a center to center spacing on the order of 6 to 18 inches. They are usually relatively uniformly spaced apart, and are spaced to create noise and vibration in a vehicle having tires passing over the grooves. The apparatus 11 is seen generally in FIG. 1, and, as shown, is comprised of four major components. The first component is in the form of a transport device 12, which is shown as a truck that moves on the pavement via wheels 14. The second component is a lift device 15 mounted to the transport 12 and operable to lift the third component, a grinding head (grinder) 17 that is operable to cut grooves in the pavement in spaced apart relationship. The fourth major component is a drive system, designated generally 18, that drives the transport 12 in synchronization with the grinder 17 operation to provide uniformly spaced apart grooves forming a rumble strip. While the transport 12 is shown as an independent and separable component from the lift device 15 and the grinder 17, it is to be understood that the lift device 15 can be made an integral part of a dedicated transport device.

The present invention will be described in terms of the transport 12 being a non-dedicated transport device. The transport 12 is shown as a truck, which is preferably heavyweight, for example weighing 8,000 pounds or more, and moving on a series of wheels 14. The transport 12 is provided with a motive device such as an internal combustion engine 19. In a preferred embodiment, the drive system 18 is a hydraulic hydrostatic drive 20, such as one made by Omsi, sold in Twinsburg, Ohio., and better described in U.S. Pat. No. 7,798,158, the contents of which are incorporated herein by reference. While a transport 12 is typically driven with a driveline including a drive shaft 21 operably connected between the motor 19 and a rear axle 22, the use of a hydrostatic drive, such as an Omsi drive 18, has the drive shaft 21 split where, within the hydrostatic drive 20, the rear wheels 14 can be driven selectively by the drive shaft or the hydrostatic drive 20. A hydraulic pump 24 can be driven by the motor 19 and provide pressurized hydraulic fluid to the hydrostatic drive 20 and other hydraulic components of the lift 15 and grinder 17. The grinder 17 components and the hydrostatic drive 20 are configured such that up-and-down movement of a grinder drum 25 is synchronized with respect to each other, such that forward motion of the transport 12 and up-and-down movement of the grinder 17 are timed to one another to create the desired spacing between the grooves cut into the pavement surface. By adjusting and/or controlling the fluid flow provided by the drive system 18, the spacing between the grooves can be adjusted as required. Synchronization is further discussed below.

Figure 2:
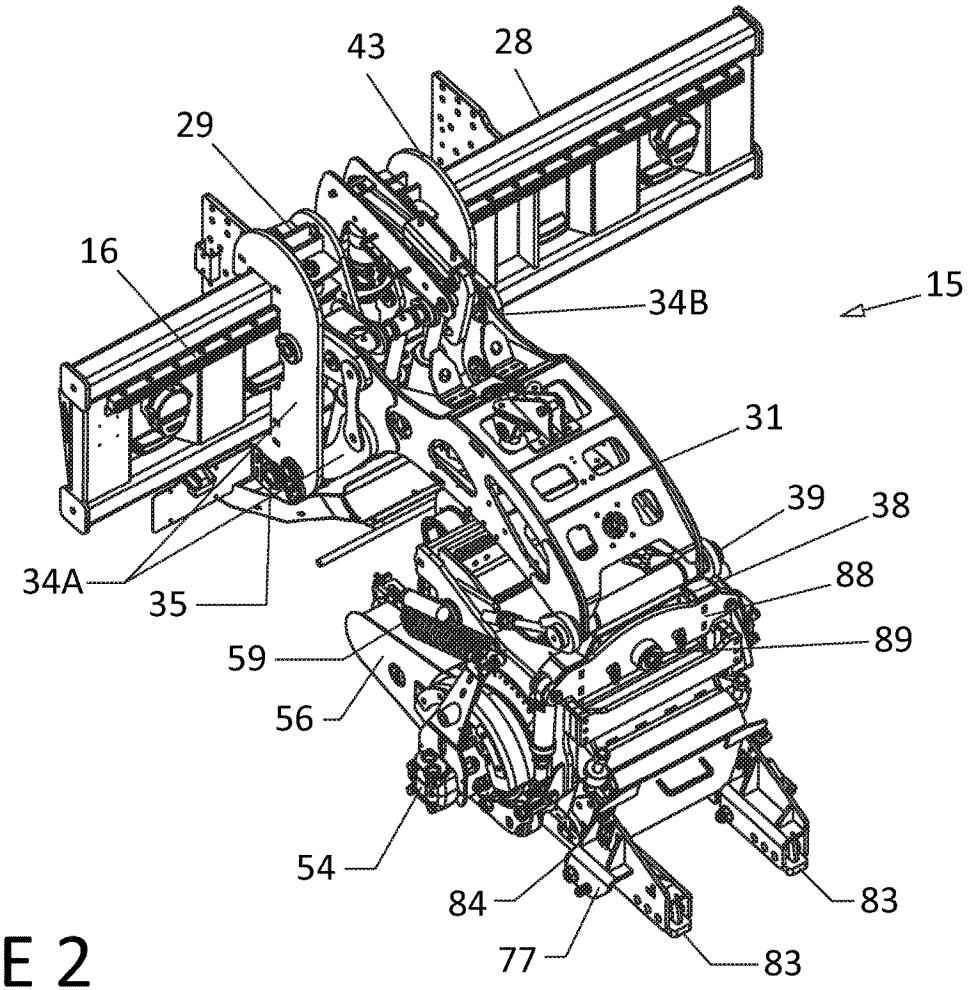
FIG. 2 is a perspective view of the grinding apparatus, elevator and attachment device.
Figure 3:
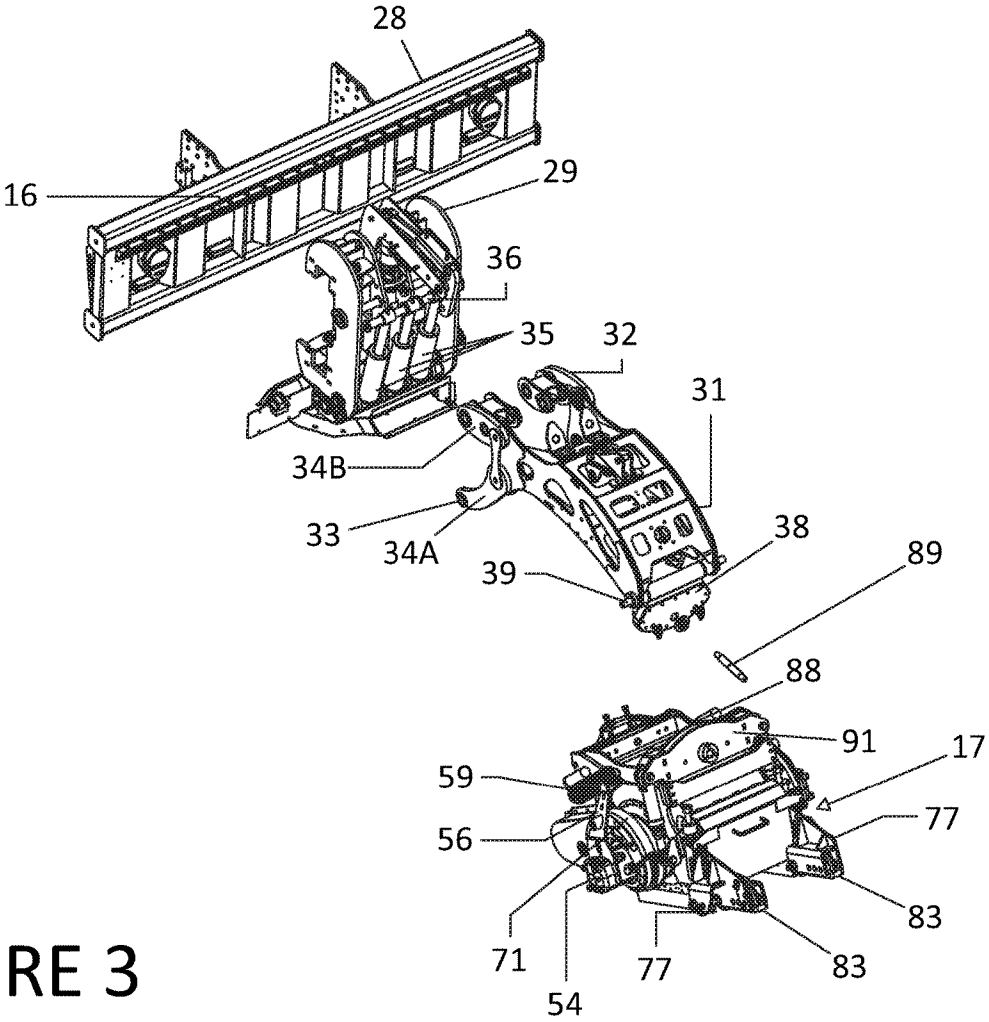
FIG. 3 is an exploded perspective view of the components seen in FIG. 2.
Figure 4:
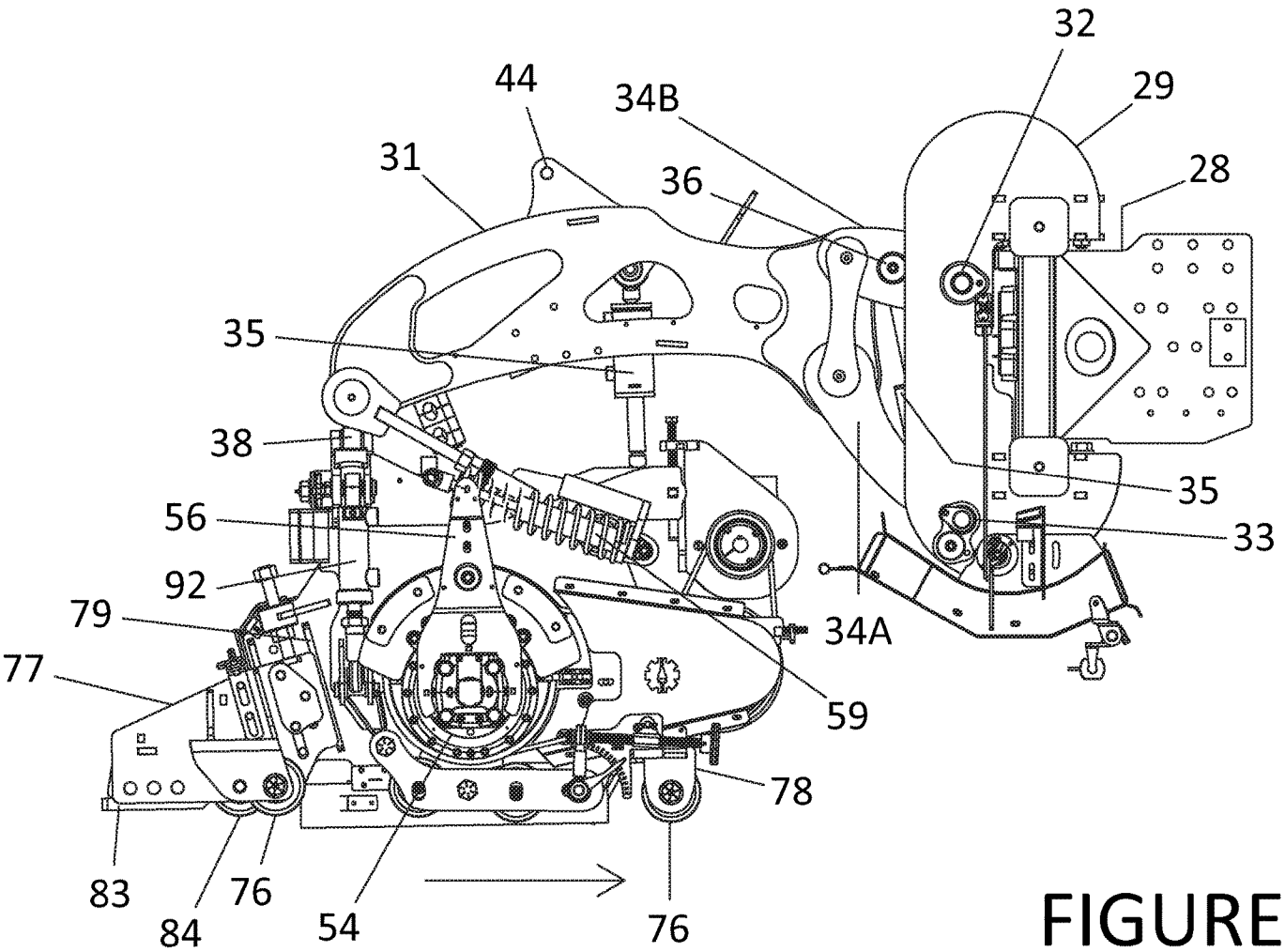
FIG. 4 is a side elevation view of the components seen in FIG. 2.

Referring to FIGS. 2-4, the lift device 15 is removably mounted to the rear end of the transport 12 so the transport 12 can be utilized for other purposes as desired. As shown, a transom 28 is removably mounted to the rear end of the transport 12 in any suitable manner. As shown, the transom 28 extends across substantially the entire width of the transport 12 to allow transverse positional adjustment of components of the lift device 15 with respect to a longitudinal axis of the transport to position the grinder 17 at a desired transverse position on the pavement.

As best seen in FIG. 2, the lift device 15 includes the transversely movable mount 29 movably mounted on the transom 28, and mounted in a manner to secure the mount 29 in a desired transverse position relative to the transport 12. The lift device 15 can be fixed in a transverse position by having one or more pins or the like (not shown) carried on the mount 29 received within a desired bore 16. A lift arm 31 is pivotally mounted on the mount 29, as at 32 and 33, using pivotal links 34A, 34B. Linear motors 35, such as hydraulic cylinders, have one end secured to the mount 29 and another end secured to a rod 36, which in turn is pivotally mounted to the arm 31. When the cylinders 35 extend, the arm 31 is raised, and when the cylinders 35 are contracted in length, the arm 31 is lowered. The construction of the hydraulic circuit for operating the cylinders 35 is such that upward movement of the arm 31 is allowed to float, while downward movement of the arm 31 is fixed, much like a three point hitch on a farm tractor.

The lift arm 31 is provided with means to connect the grinder 17 to the lift arm 31, and preferably allow pivoting movement about an axis, generally normal to the direction of travel of the apparatus 11. As shown, a hitch plate 38 is pivotally mounted on the lift arm 31 at a distal end thereof, as with a pivot pin 39, as seen in FIG. 3. Descriptions of location and orientation herein are to be construed as if the front is the forward end 40 of the transport 12, and the normal direction of movement would be from the rear 41 of the transport 12 toward the forward end 40. For transport of the grinder 17 during non-use periods, the lift device 15 elevates the grinder 17 from the ground by extending the cylinders 35. The lift device 15 can be locked into its elevated position by a suitable latch device, which is shown as including a pivotally mounted hook 43 that is selectively engageable with a latch 44.

Figure 5:
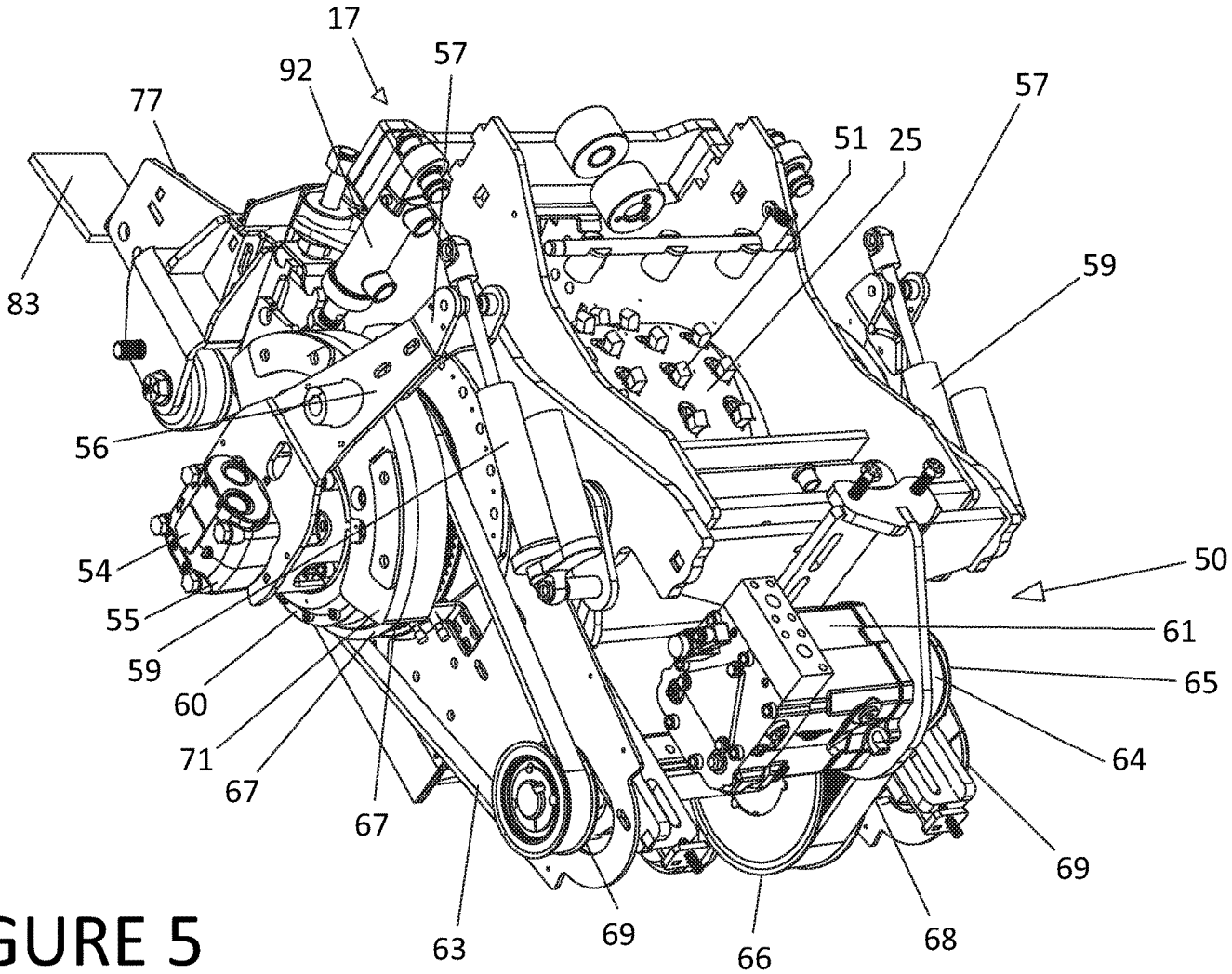
FIG. 5 is a perspective view of the grinder section as viewed generally from the front of the grinder.
Figure 6:
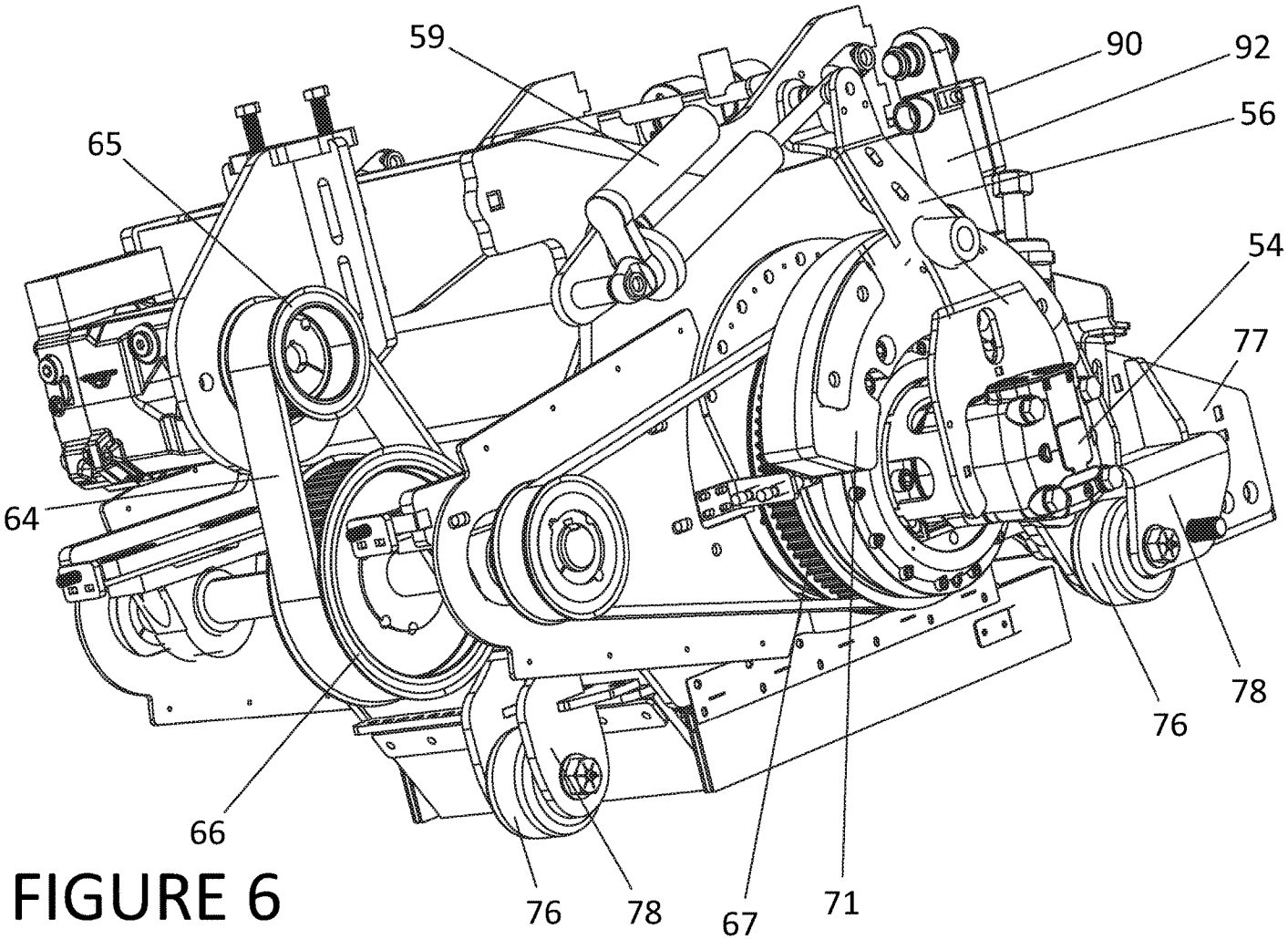
FIG. 6 is a perspective view of the grinder section as viewed generally from the front of the grinder, but on the opposite side as viewed in FIG. 5.
Figure 7:
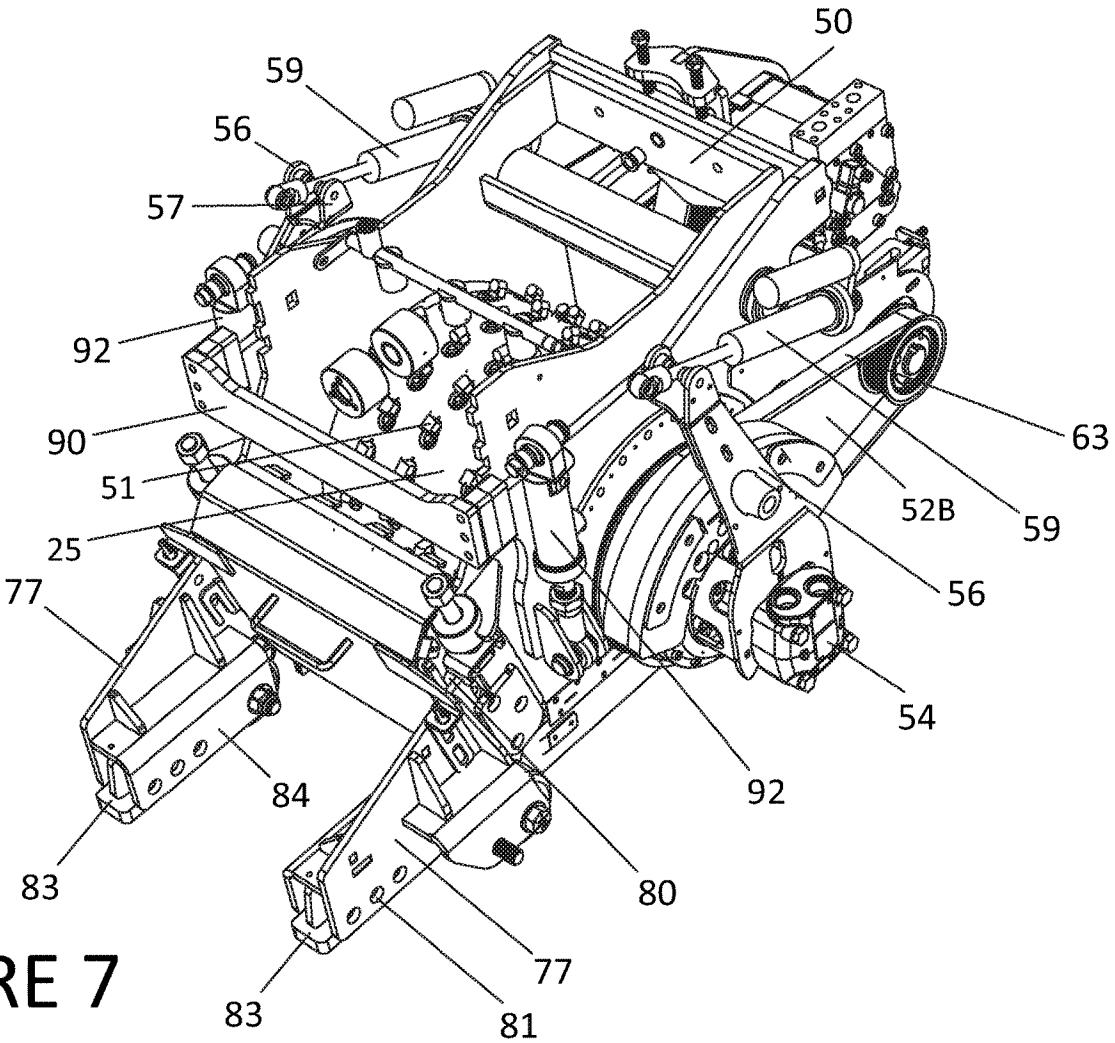
FIG. 7 is a perspective view of the grinder section as viewed generally from the rear of the grinder.
Figure 8:
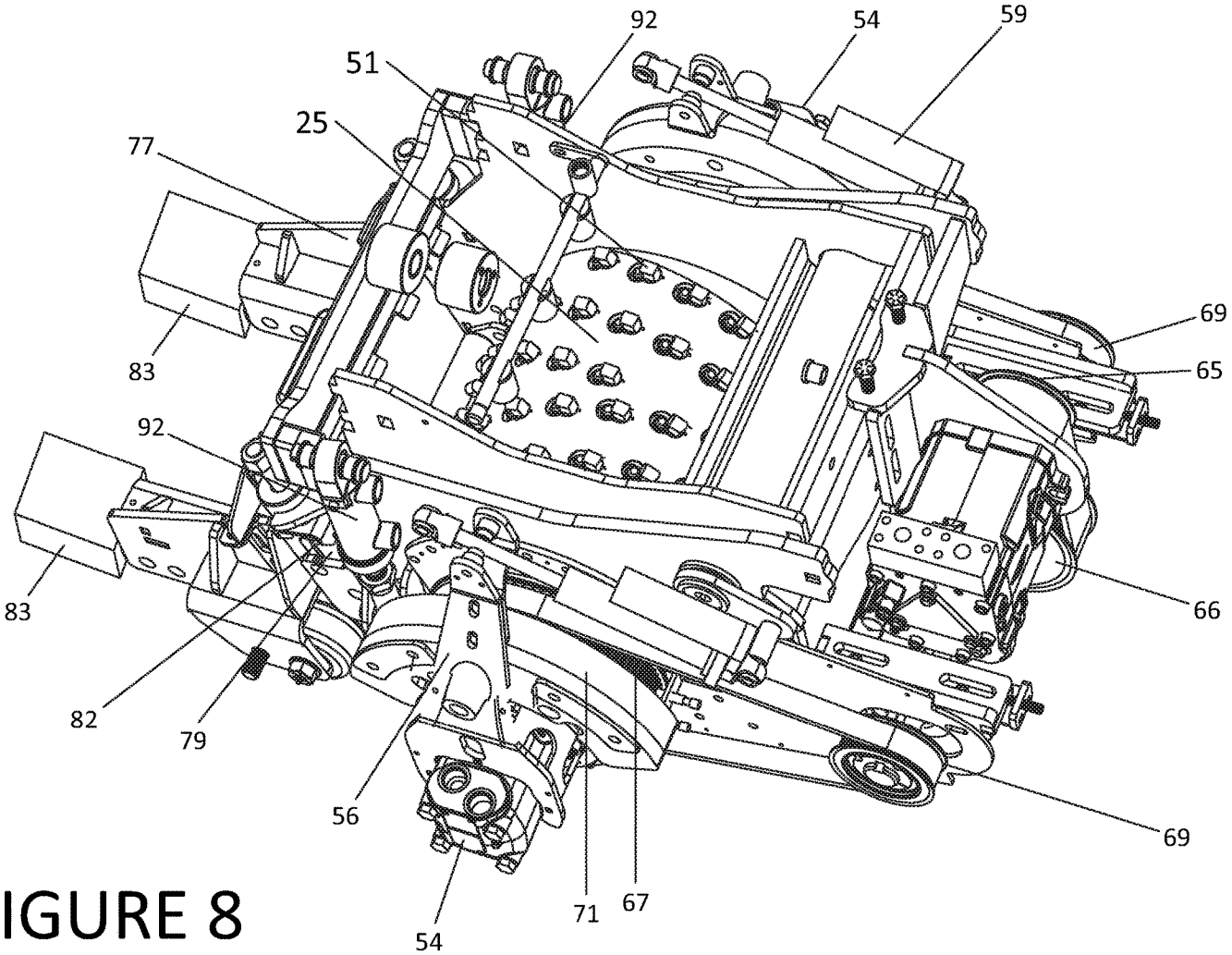
FIG. 8 is a perspective view of the grinder section as viewed generally from the top thereof.

FIGS. 5-10 illustrate the details of the grinder 17. The grinder 17 includes the grinding drum 25, which is rotatably mounted on a frame 50. As best seen in FIG. 7, the grinding drum 25 has a plurality of laterally and circumferentially spaced apart cutters 51 mounted thereto, and preferably constructed so that the cutters 51 can be replaced when worn. The drum 25 is rotatably mounted on the frame 50 as between two side plates 52A and 52B. The drum 25 has an axle having an end extending beyond each end of the drum 25, with each end being connected to a rotary drive, such as a hydraulic motor 54 operably connected to the hydraulic pump 24. The hydraulic motors 54 are operable to effect rotation of the drum 25 in a counterclockwise direction, as seen in FIG. 4. This means that the cutters 51 are moving in a forward direction when engaging pavement for material removal. This effects a rearward directed dragging force on the grinder 17 when being operated. The housings 55 for the motors 54 are fixed against rotation during rotation of the drum 25, as with arms 56, each connected to a respective hydraulic motor 54. Each of the arms 56 have a free end 57 connected to means to allow slight, but limited, movement of the arms 56 about the axis of rotation of the drum 25. In the illustrated structure, spring loaded shock absorbers 59 are each pivotally mounted to the frame 50 at one end, while the other end is pivotally attached to their respective arm end 57. Thus, when the grinding drum 25 initially engages the pavement for forming a rumble strip groove, some of the shock/force of the applied torque is absorbed by the shock absorbers 59.

Figure 10:
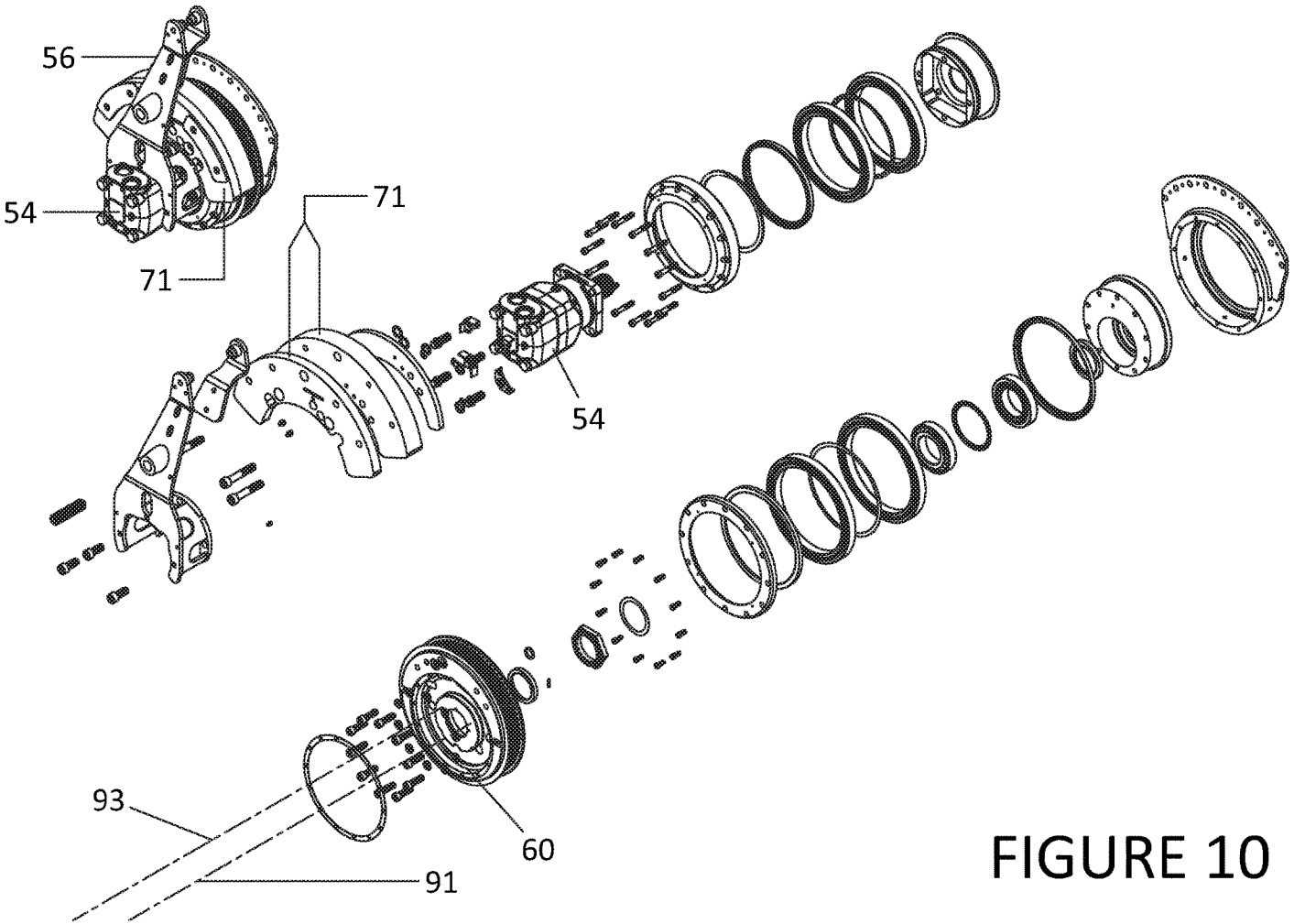
FIG. 10 is an exploded perspective view of an eccentric drive portion used to drive the grinder drum.

The drum 25 rotates on its axle and is driven by the hydraulic motors 54 as described above. In addition, the drum 25 also moves up and down to effect selective engagement of the cutters 51 with the pavement to form spaced apart grooves in the pavement. In the illustrated embodiment, the drum 25 and its hydraulic motors 54 revolve about an axis parallel to the rotation of the drum 25. This is accomplished by having the drum 25 mounted to an eccentric 60 as seen in FIG. 10. There is an eccentric 60 on each side of the drum 25. The eccentrics 60 are mounted for rotation about their own center, having axis of rotation 93, with the center of the mount for the drum 25 being offset from this center and having axis of rotation 91 (FIG. 10). Thus, the drum 25 has complex movement. This offset of the center for the eccentrics 60 is the same for both sides of the drum 25 in order to maintain the drum 25 generally parallel to the ground or pavement during rotation. It has been found preferable to have the revolving of the eccentrics 60 be in a clockwise direction as viewed in FIG. 4, which is opposite to the direction of the rotation of the drum 25. It should be noted that this construction causes the drum 25 to move rearward as it moves downward into the pavement. This construction allows the width of the groove to be more accurately controlled, and reduces the load on the drum 25 due to the fact that it is not drawn forward with the vehicle chassis and is allowed to cut the pavement in a downward motion instead of a downward and forward motion.

As discussed above, the apparatus 11 is operable to provide pressurized hydraulic fluid from the pump 24 to the hydrostatic drive 20, the hydraulic motors 54, and a hydraulic motor 61, see FIG. 1. The hydraulic motor 61 is suitably mounted on the frame 50 and movable therewith. The hydraulic motor 61 and the hydraulic motor in the drive 20 are such as to be able to operate the motors at relative fixed speeds to effect synchronization of the up-and-down movement of the drum 25 with the forward motion of the transport 12. This can be effected by the use of swash plate or wobble plate hydraulic motors. As seen in FIGS. 5 and 6, the motor 61 is operably connected to the eccentrics 60 as through toothed belts 63, 64 and toothed pulleys 65, 66, 67. The toothed pulley 65 is mounted to the motor 61. The toothed pulley 66 is driven by the toothed pulley 65 and belt 64, and is mounted to an axle 68 that is rotatably mounted on the frame 50. The axle 68 has mounted on each end thereof a toothed pulley 69 that in turn drive the belt 63, and hence the toothed pulley 67. The motor 61 and its associated drive components effect the revolving of the drum 25 and its up-and-down movement components. The revolving movement of the drum 25 is generally circular.

The grinder 17 is provided with means to assist the cutters 51 to engage the pavement and cut the rumble strip grooves. As described above, the drum 25 and cutters 51 have upward and downward movement components because the drum 25 is revolving and rotating. The weight of the grinder 17 and the revolving motion of the drum 25 move and hold the cutters 51 in cutting engagement with the pavement. Additional means is provided to balance the rotation of the eccentrics as the drum engages with the pavement. As seen in FIGS. 5 and 10, weights 71 are mounted to the eccentrics 60 on each end of the drum 25, placing the drum 25 in a balanced condition during revolving of the eccentrics. As seen in FIG. 5, the weights 71 are at a top position with the drum 25 being at its lowermost position for revolution. During the revolution of the drum 25, moving it toward its lowermost position, the weights 71 may provide a resistive downward force from momentum to assist the cutters 51 in engaging and cutting the pavement, and to counterbalance the reactive force of the cutters engaging the pavement. The weight of the grinder 17 is sufficient to maintain its engagement with the pavement during operation to counterbalance the movement of the revolving of the drum 25.

Figure 9:
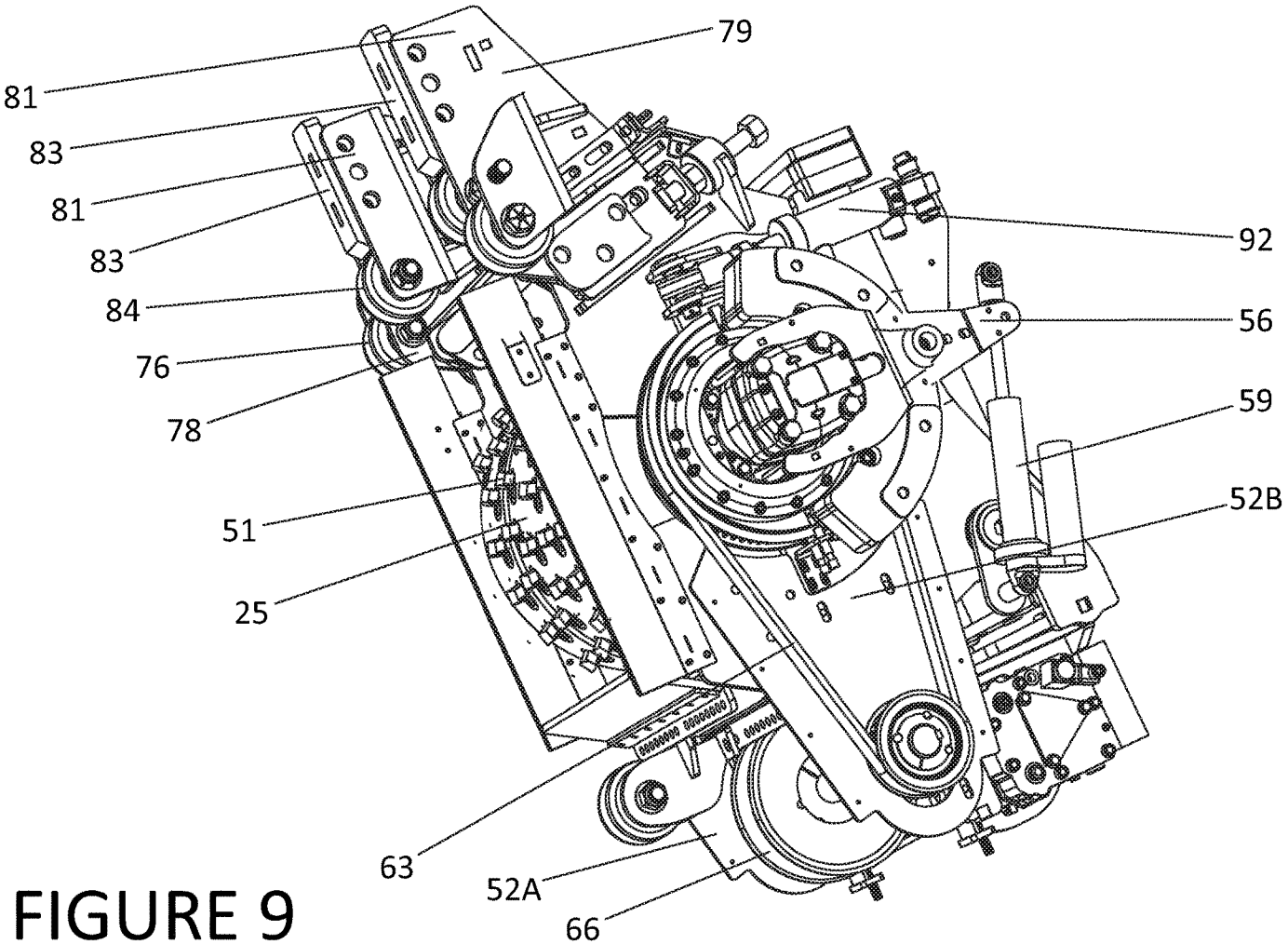
FIG. 9 is a perspective view of the grinder section as viewed generally from the bottom thereof.

The grinder 17 travels along the pavement during operation. Preferably, the grinder 17 has a plurality of bottom mounted wheels 76 rotatably mounted to the frame 50 via support brackets 78. As shown in FIGS. 6 and 9, there is one forward wheel 76 and two rear wheels 76. The forward wheel 76 is positioned forwardly of the hitch plate 38 (see FIG. 3) for a purpose later described. The grinder 17 is also provided with trailing wheels 84. Each of the trailing wheels 84 is rotatably mounted on a respective mounting bracket 81. The forward end of each of the brackets 77 is mounted to a plate 79 positioned at the rear of the frame 50. The plates 79 are angled such that the bottom end of each plate 79 is positioned forward of the top end of the plate. The brackets 77 also have plates 80, each removably mounted to and movable relative to a respective plate 79. This allows the brackets 77 to move relative to the plates 79 in a generally vertical direction. This can be done by providing the plates 80 with elongate generally vertical slots 82 and securing the brackets 77 to the plates 79 via bolts extending through the slots 82. In a preferred embodiment, positioned just above the bottom of each of the trailing wheels 84 is a skid plate 83. Should a wheel 84 enter a depression or hole in the pavement, the skid plate 83 will support the brackets 77 and the frame 50 until the depression or hole is passed. During normal groove cutting operation, the brackets 77 are in their uppermost position.

The grinder 17 is constructed to allow selective skipping of rumble strip groove formation. For example, the grinder 17 can form two grooves, skip one, form two, skip one, or form any other desired combination of grooves and skips. Means to accomplish this is best seen in FIGS. 3, 4. As described above, the grinder 17 is suspended from the hitch plate 38 that is secured to the lift arm 31. The hitch plate 38 is mounted to a yoke 88 via a pin 89, FIG. 3. The yoke 88 is positioned adjacent the rear of the frame 50. The yoke 88 is, in turn, movably mounted on the frame 50 as by having a plate 90 sandwiched between opposing spaced apart plates 91 of the yoke 88. As described above, the hitch plate 38 can pivot forward and rearward relative to the lift arm 31. A pair of linear motors, such as hydraulic cylinders 92, are mounted to the frame 50, as shown, one on each side thereof adjacent the rear end of the frame 50. Contraction of the length of the cylinders 92 lifts the rear end of the frame 50, allowing it to pivot on the front wheel 76, moving the rear end up and down. Because the brackets 77 can move relative to the frame 50, they remain on the ground during pivoting movement of the frame 50. The lift amount of the cylinders 92 is sufficient to prevent the cutters 51 from engaging the pavement. Extension of the cylinders 92 to their normal extended length allows the cutters 51 to reengage the pavement for cutting. Extension and contraction of the cylinders 92 can be controlled by suitable hydraulic valving timed to coordinate with the revolving of the drum 25 and its up-and-down movements. Pivoting movement of the frame 50 by the cylinders 92 is damped by the shock absorber 59. The shock absorber 59 has one end pivotally connected to the lift arm 31 and the other end pivotally connected to the frame 50, see FIG. 4.

The cutting depth achieved by the cutters 51 can be suitably adjusted. In a preferred embodiment, one means of effecting cutting depth is to adjust the height of the wheels 76 relative to the frame 50. This can be done easily by using spacers or spaced holes so that the wheels do not accidentally move from their fixed positions.

The transport 12 can be provided with a water tank 95 and a pump (not shown) to provide water through a conduit 96 to be dispensed adjacent the drum 25 to both cool the cutters 51 and to reduce dust and debris from being dispensed by the grinder 17. Further, the drum 25 and the cutters 51 will be positioned inside a housing secured between the side plates 52A, 52B to both control dust emissions and to provide for worker safety. The housing components should be easily removable to provide access to both the drum 25 and the cutters 51 for maintenance.

Figure 11:
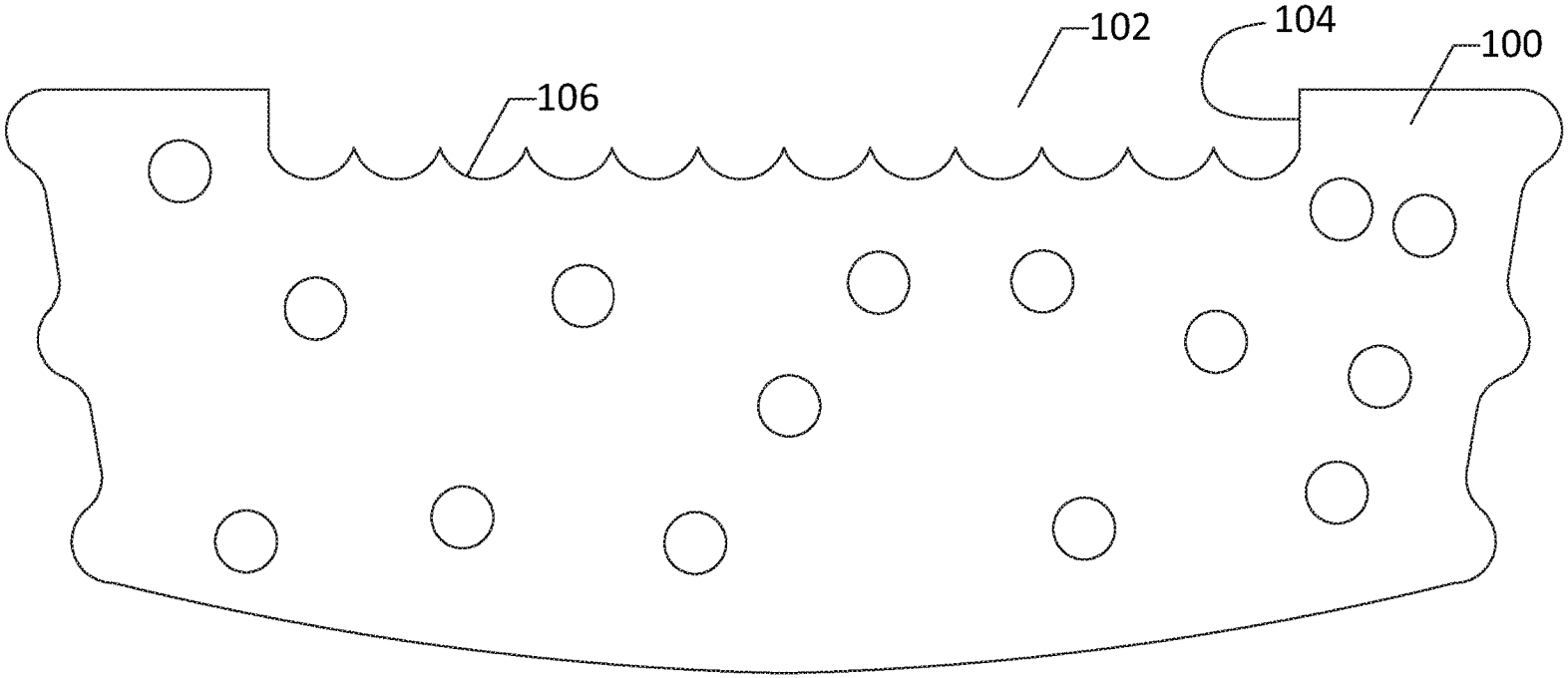
FIG. 11 is a partial section view illustrating a cross section of pavement that has been ground away for marking removal or a rumble strip.
Figure 12:
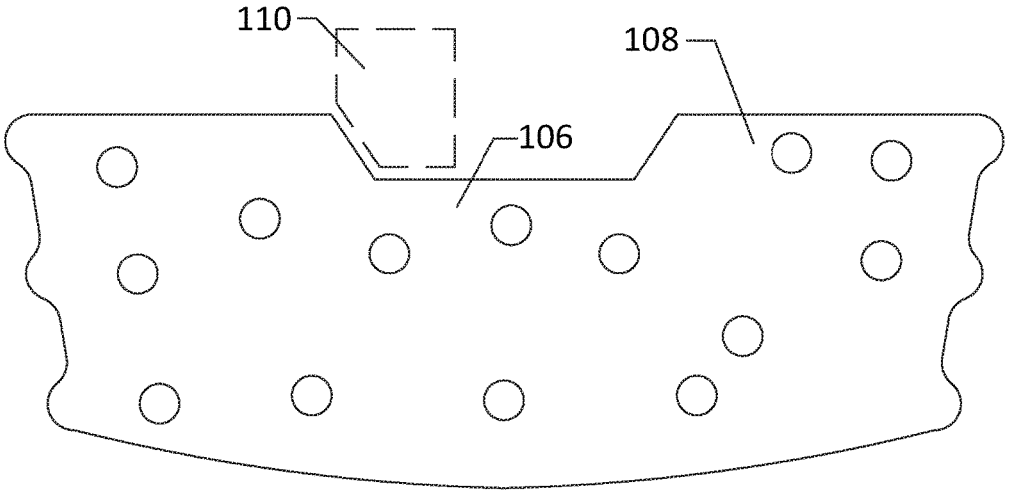
FIG. 12 is a partial section view illustrating a modified cross section of pavement that has been ground away for marking removal or a rumble strip.
Figure 13:
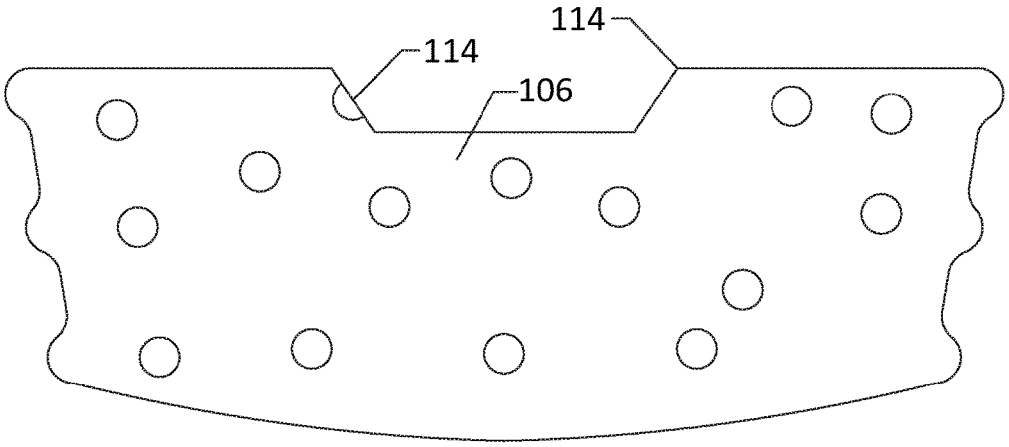
FIG. 13 is a partial section view illustrating a cross section of pavement that has been ground away for marking removal or a rumble strip.
Figure 14A:
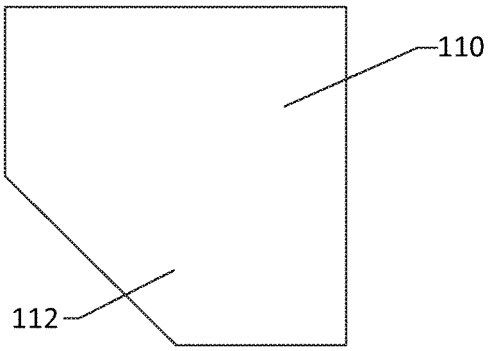
FIG. 14A is a front view of a cutter shape suitable for the present invention that provides a modified side edge shape to the ground away pavement.
Figure 14B:
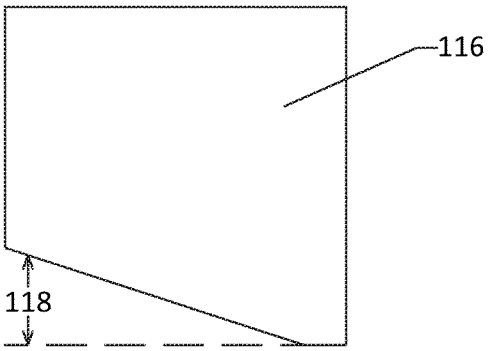
FIG. 14B is a front view of a cutter shape suitable for the present invention that provides a modified side edge shape to the ground away pavement.
Figure 14C:
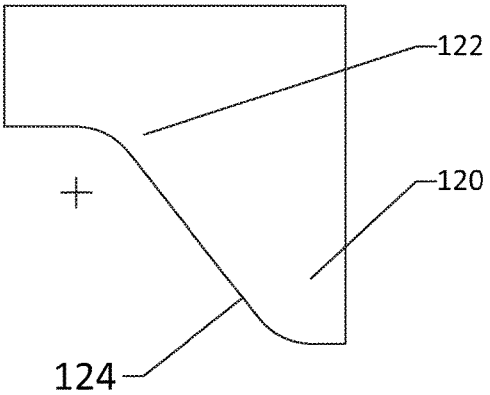
FIG. 14C is a front view of a cutter shape suitable for the present invention that provides a modified side edge shape to the ground away pavement.

Referring to FIGS. 11-14C, various cross sectional profiles of the ground pavement 100 having a groove 102 produced by a grinding or machining apparatus are illustrated. FIG. 11 illustrates a current state of the art cross section wherein cutters 51 are utilized in the grinder that produce side walls 104 substantially perpendicular to the bottom surface 106 of the ground section. While this side wall 104 is effective for removing road markings or for the side wall of a rumble strip, it does present problems for some vehicles. Motorcycles and some smaller cars have tires small enough to be affected by the side wall 104; particularly when a cutter of this type has been used to remove center lines of a roadway, whereby the tires cross the groove when changing lanes. Thus, the present device is suitable for using shaped cutters to bevel or radius the side walls 104 to reduce or eliminate the problems caused by the near vertical side walls. FIG. 12 illustrates one example of a beveled side wall 108 formed by utilizing a bevel shaped cutter 110 as shown in FIG. 14A. As illustrated in FIG. 14A, the bevel 112 on the cutter is illustrated on the left hand side of the cutter; however, it should be noted that the bevel may be placed on the left or the right hand side of the cutter without departing from the scope of the invention. By utilizing the bevel cutter, the side wall 108 is cut upon an angle to smooth the transition of a tire rolling across a groove or rumble strip formed by the present device. In a most preferred embodiment, the cutter is formed from polycrystalline diamond or carbide and includes steel backing portions for mounting the cutter to the drum 25. Referring to FIG. 13, an angled side wall 114 is illustrated. The angled side wall 114 is cut utilizing an angled cutter 116. The angled cutter 116 is suitable for forming longer angled side walls than the beveled cutter 110. In addition, either of the beveled or the angled cutters can include any suitable angle 118 for modifying the transition between the side wall and the bottom wall 106. FIG. 14C illustrates yet another embodiment of the cutter 51 including a first radius 120, a second radius 122 and an angled tangent surface 124 extending between the two radiuses 120, 122.

It is to be understood that while a certain form of the invention is illustrated, it is not to be limited to the specific form or arrangement herein described and shown. It will be apparent to those skilled in the art that various changes may be made without departing from the scope of the invention, and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. An apparatus for forming rumble strip grooves in a roadway comprising:

a transport including an elongate frame, said elongate frame including at least one axle, said at least one axle secured transversely to said elongate frame, said axle having at least one wheel mounted on each opposite end of said axle for transport of said apparatus for forming rumble strip grooves on a surface;

a grinding head secured to said transport to be moveable therewith, said grinding head including a rotary cutting tool that is operable to cut grooves in said roadway in spaced apart relationship, said rotary cutting tool including a drum rotatably mounted to a grinder frame between two side plates and at least one cross plate forming said grinder frame, each end of said drum including an axle extending outward from each end of said drum, a drive motor operably connected to each said axle to provide selective rotation to said drum, said drum and said drive motors mounted to an eccentric on each side of said drum, said eccentrics mounted for rotation about an eccentric axis of rotation so that said rotary cutting tool moves in a rearward direction with respect to a forward travel direction of said elongate frame during said groove cutting operation, said drum and said eccentric having different axes of rotation;

a lift device operable to lift said rotary cutting tool of said grinding head to a first position above a top surface of said roadway and control a depth of cut to a second position below said top surface of said roadway; and a drive system for synchronizing said transport with said grinding head to provide spaced apart grooves in said surface by causing said lift device to move said rotary cutting tool between said first position and said second position for cutting of said rumble strips at a predetermined spacing.

2. The apparatus for forming rumble strip grooves in a roadway of claim 1 wherein said drive motor is a hydraulic motor.

3. The apparatus for forming rumble strip grooves in a roadway of claim 1 wherein said drum includes a plurality of spaced apart removable and replaceable cutters.

4. The apparatus for forming rumble strip grooves in a roadway of claim 1 wherein each said eccentric includes a weight secured thereto, each said weight secured to said eccentric to balance the weight of said offset drum during rotation of said eccentrics.

5. The apparatus for forming rumble strip grooves in a roadway of claim 1 wherein said transport is provided with a water tank and a pump for delivery of water through a conduit to be dispensed adjacent said drum for cooling said cutters.

6. The apparatus for forming rumble strip grooves in a roadway of claim 1 wherein said elongate frame and said at least one axle is a trailer.

7. The apparatus for forming rumble strip grooves in a roadway of claim 1 wherein said rumble strip is in the form of a series of elongate grooves cut into said pavement with said grooves being in spaced apart relationship along the length of said pavement and each said groove having a longitudinal axis extending transverse to the direction of vehicle travel.

8. The apparatus for forming rumble strip grooves in a roadway of claim 1 wherein each said groove is 6 to 18 inches long.

9. The apparatus for forming rumble strip grooves in a roadway of claim 1 wherein each said groove is 4 to 8 inches wide.

10. The apparatus for forming rumble strip grooves in a roadway of claim 1 wherein said grooves include a center to center spacing of 6 to 18 inches.

11. The apparatus for forming rumble strip grooves in a roadway of claim 1 wherein each said drive motor is fixed against counter rotation with respect to drum with an elongated arm secured to each said drive motor, each said arm including a free end, said free end secured to one end of a spring loaded shock absorber, a second end of each said spring loaded shock absorber being secured to said grinder frame so that a portion of a shock force from engaging said drum to said surface is absorbed by said spring loaded shock absorber.

12. The apparatus for forming rumble strip grooves in a roadway of claim 1 wherein said grinder frame includes a plurality of wheels secured to a bottom surface thereof for supporting the weight of said apparatus for forming rumble strips.

13. The apparatus for forming rumble strip grooves in a roadway of claim 12 wherein said grinder frame includes a skid plate secured to be just above a ground surface when said grinder frame wheels are in engagement with said ground surface, said skid plate preventing any one of said plurality of grinder frame wheels from dropping into a depression, thereby preventing said drum from errantly gouging said ground surface.

14. The apparatus for forming rumble strip grooves in a roadway of claim 1 wherein said apparatus for forming said rumble strip grooves is constructed and arranged to allow selective skipping of said rumble strip grooves.

15. The apparatus for forming rumble strip grooves in a roadway of claim 14 wherein said grinder frame includes at least one hydraulic cylinder secured between said grinder frame and a hitch plate for lifting a portion of said grinder frame to prevent said drum from engaging a ground surface.

16. The apparatus for forming rumble strip grooves in a roadway of claim 15 including a computer controlled valve for operation of said at least one hydraulic cylinder.

17. The apparatus for forming rumble strip grooves in a roadway of claim 1 wherein said elongate frame includes an engine and a driveline for causing powered rotation of said wheels.

18. The apparatus for forming rumble strip grooves in a roadway of claim 17 wherein said elongate frame, said engine, said driveline and said at least two wheels comprise a truck.

19. The apparatus for forming rumble strip grooves in a roadway of claim 18 wherein said truck includes a hydraulic hydrostatic drive.

20. An apparatus for forming rumble strip grooves in a roadway comprising:

a transport including an elongate frame, said elongate frame including at least one axle, said at least one axle secured transversely to said elongate frame, said axle having at least one wheel mounted on respective opposite ends of said axle for transport on a surface;

a grinding head secured to said elongate frame for movement therewith, said grinding head including a rotary cutting tool that is operable to cut grooves in said roadway in spaced apart relationship, said rotary cutting tool including a drum rotatably mounted to a grinder frame between two side plates and at least one cross plate forming said grinder frame, said grinder frame including a grinder frame wheel on each respective side of said grinder frame;

a lift device operable to lift said rotary cutting tool of said grinding head to a first position above a top surface of said roadway and control a depth of cut to a second position below said top surface of said roadway;

a drive system for synchronizing said transport with said grinding head to provide spaced apart grooves in said surface by causing said lift device to move said rotary cutting tool between said first position and said second position for cutting of said rumble strips at a predetermined spacing; and said grinder frame including a skid plate secured to be just above a ground surface when said grinder frame wheels are in engagement with said ground surface, said skid plate preventing any one of said grinder frame wheels from dropping into a depression, thereby preventing said rotary cutting tool from errantly gouging said ground surface.

* * * * *